US006536989B2

(12) United States Patent
Rijkers

(10) Patent No.: US 6,536,989 B2
(45) Date of Patent: Mar. 25, 2003

(54) FINISHING DEVICE FOR FLOORS MADE OF HARDENABLE MATERIAL AND BLADE USED THEREWITH

(75) Inventor: Wilhelmus Cornelis Hendricus Maria Rijkers, Lommel (BE)

(73) Assignee: B-MAC, besloten vennootschap met beperkte aansprakelljkheld, Overpelt (BE)

( * ) Notice: Subject to any disclaimer, the term of this patent is extended or adjusted under 35 U.S.C. 154(b) by 0 days.

(21) Appl. No.: 09/863,309

(22) Filed: May 24, 2001

(65) Prior Publication Data

US 2002/0017073 A1 Feb. 14, 2002

(30) Foreign Application Priority Data

May 24, 2000 (BE) ..... 2000/0345

(51) Int. Cl.[7] ..... E01C 19/22
(52) U.S. Cl. ..... 404/112
(58) Field of Search ..... 404/112; 451/353; 403/409.1, 374.3

(56) References Cited

U.S. PATENT DOCUMENTS 2,767,609 A * 10/1956 Cousino ..... 411/436
2,888,863 A * 6/1959 Eisnbeis ..... 404/112
3,296,946 A 1/1967 Cagno
3,375,766 A * 4/1968 Zochil ..... 404/112
3,402,647 A 9/1968 Colizza et al.
3,675,544 A 7/1972 Zochil
4,556,339 A 12/1985 Morrison
5,480,257 A * 1/1996 Allen ..... 404/112
6,419,419 B1 * 7/2002 Kelsay, III ..... 404/112

FOREIGN PATENT DOCUMENTS

CA 763874 * 7/1967

* cited by examiner

*Primary Examiner*—David Bagnell
*Assistant Examiner*—Sunil Singh
(74) *Attorney, Agent, or Firm*—Bacon & Thomas, PLLC

(57) ABSTRACT

A finishing device for floors made of hardenable material including a frame, at least one rotating tool connected to the frame and a driving mechanism provided on the frame and configured to drive the at least one rotating tool. The rotating tool includes at least two arms that each have a blade connected thereto via a connection arrangement. The connection arrangement includes a first part mounted onto the blade and a second part connected to the arm. The first arm connects to the second part and slidably engages therewith such that the blade can be adjusted and fixedly clamped along a longitudinal dimension of the arm.

10 Claims, 2 Drawing Sheets

FINISHING DEVICE FOR FLOORS MADE OF HARDENABLE MATERIAL AND BLADE USED THEREWITH

BACKGROUND OF THE INVENTION

1. Field of the Invention

This invention relates to a finishing device for floors made of hardenable material, in particular concrete or mortar, which device comprises a frame, at least one rotating tool connected thereto and provided with at least two arms upon each of which a blade is fixed, and a driving mechanism, provided on the frame, for driving the tool.

2. Discussion of the Related Art

Such finishing devices are applied for processing particles, such as quartz particles, into poured and still soft hardenable material, for leveling the hardenable material previous to the complete hardening thereof, or for polishing the material during hardening.

In known finishing devices of this kind, a beam is attached to the upper side of each blade, mostly riveted into place, and the blade is fixed to an arm of the tool by means of screws or bolts which are screwed through the arm into the beam.

In order to replace or exchange a blade, the screws or bolts must be completely screwed off the beam, which is time-consuming.

Mostly, three openings are provided in the beam, of which only two are used for fixation to an arm, whereby these openings can be different, depending on whether the arm is short or long.

Especially in the case of a short arm, there are openings which remain free and into which cement and other dirt may penetrate.

For a short arm, in fact, bolts are screwed into the central and one of the two outer openings. Into the third opening, cement or other dirt may penetrate, such that, when one wants to attach the blade to the arm in another position, to wit in the position in which said third opening of the beam is situated the most outward, it will become difficult to screw a bolt into this dirty third opening and, therefore, the fixation of the beam at the arm is difficult or impossible.

Moreover, the position of the beam, and therefore also of the blade, is fixed in respect to the arm.

For finishing the borders, mostly another finishing device is used than for finishing the central surfaces, and up to now, two different finishing devices are used to this end.

SUMMARY OF THE INVENTION

The invention aims at a finishing device for floors made of hardenable material which does not have these disadvantages and whereby the blades can be replaced or exchanged in a fast and simple manner and the blades can be fixed in an adjustable manner in respect to the arms, such that it is also possible to provide different types of blades in the same tool and the position of the blades can be chosen such that it is possible to perform the finishing very close to the walls, such that a special border-finishing device no longer is necessary.

According to the invention, this aim is achieved in that the blade is fixed to an arm of the tool by means of a connection with at least two parts which can be adjusted in respect to each other in the longitudinal direction of the arm, the first part of which is mounted on the blade and the second part is connected to the arm by means of connecting means and can be fixedly clamped onto this first part.

Preferably, the first part of the connection is an open-box profile extending parallel to the arm, whereas the second part is situated with at least a portion within the open-box profile.

A channel or open-box profile is a profile with a C-shaped cross-section which is open at both extremities.

In a form of embodiment, the second part can be clamped onto the first part by means of the connecting means by which the second part is connected to the arm.

These connecting means may comprise at least one screw or bolt which protrudes through the arm and is screwed into said second part, or may comprise at least one bolt which extends through the arm and through the second part and onto which a nut is screwed.

The second part may be a beam fitting, with a play and in a movable manner, into the open-box profile, whereby, thus, parts of the open-box profile can be clamped between the beam and the arm by the connecting means.

In another form of embodiment, this second part is formed by a portion of the connecting means themselves, and these connecting means consist, for example, of at least one bolt with a nut, whereby the bolt extends through the arm and through the slot into the open-box profile and either the head of the bolt, or the nut is situated within the open-box profile and forms the aforementioned second part.

In the last case, this second part can be clamped on the first in that parts of the open-box profile are clamped between the beam and the head of the bolt, the nut, respectively, by screwing the nut onto the bolt.

The invention also relates to a blade obviously destined for being used in the finishing device according to the invention described in the aforegoing and which is characterized in that a hollow profile, in particular an open-box profile, is attached thereupon.

BRIEF DESCRIPTION OF THE DRAWINGS

With the intention of better showing the characteristics of the invention, hereafter, as an example without any limiting character, a preferred form of embodiment of a finishing device and a blade used therewith according to the invention are represented, with reference to the accompanying drawings, wherein.

DESCRIPTION OF THE PREFERRED EMBODIMENT

Figure 1:
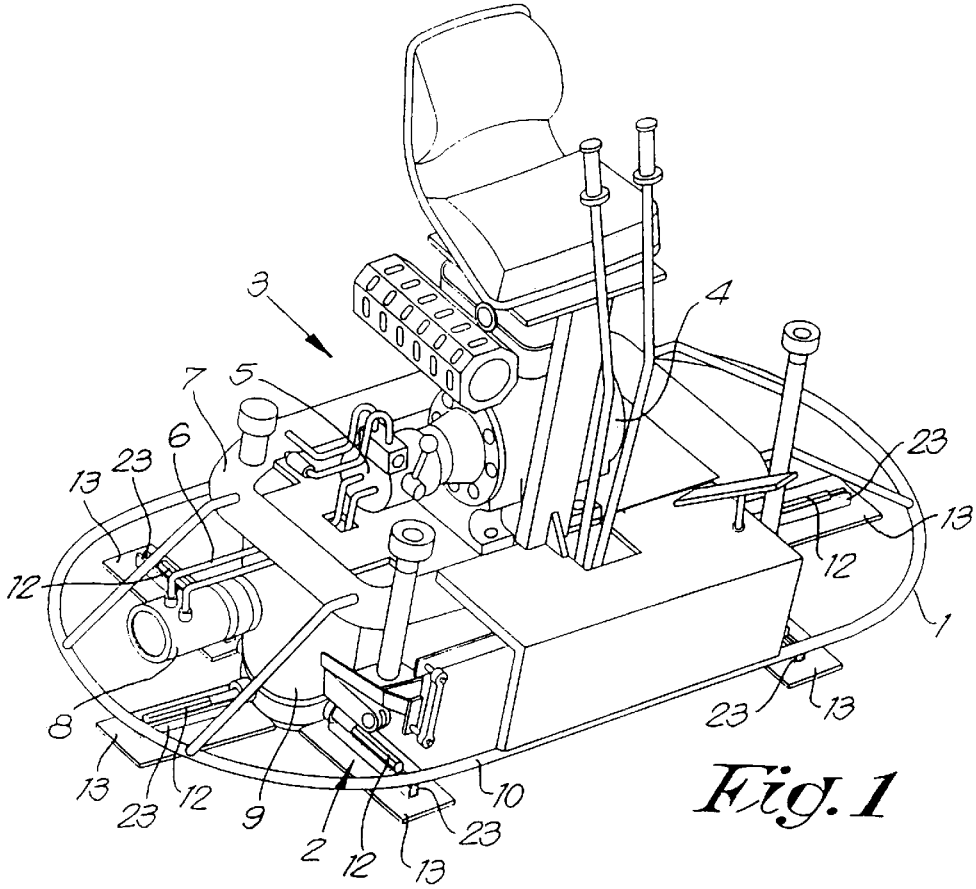
FIG. 1 represents a perspective view of a finishing device according to the invention.

As represented in FIG. 1, the finishing device according to the invention substantially consists of a frame 1, one or more, in the example two, rotating tools 2 provided thereupon, and a driving mechanism 3 for synchronously driving said tools 2.

The driving mechanism 3 consists of a driving motor 4 driving a pump 5 with a variable flow rate which forms part of a hydraulic circuit 6 in which a liquid reservoir 7 is provided as well as a hydromotor 8 which drives the two tools 2 by means of two reduction boxes 9, each having a vertical shaft and coupled to each other by means of a mechanical universal coupling.

The liquid reservoir 7 is fixed to the frame 1 which below comprises a bordering 10.

Each tool 2 substantially consists of a hub 11, four radial arms 12 positioned in cross-shape, and on each arm 12 a blade 13 which is connected to the arm 12 by means of connection 14 in a continuously adjustable manner.

The hub 11 is fixed at he shaft of a reduction box 9.

Figure 2:
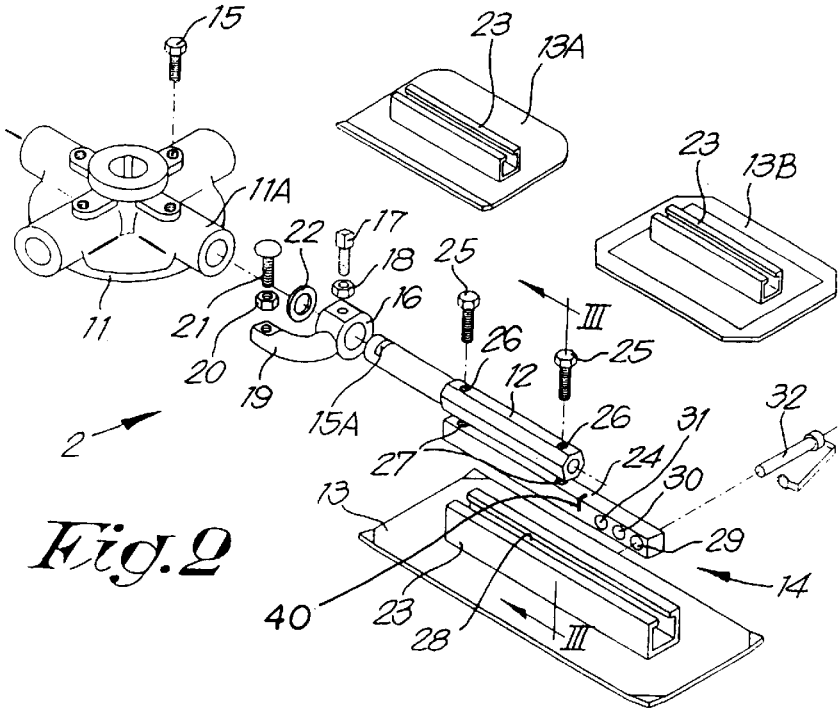
FIG. 2 represents a portion of a tool from the finishing device of FIG. 1, drawn with the parts in exploded view.
Figure 3:
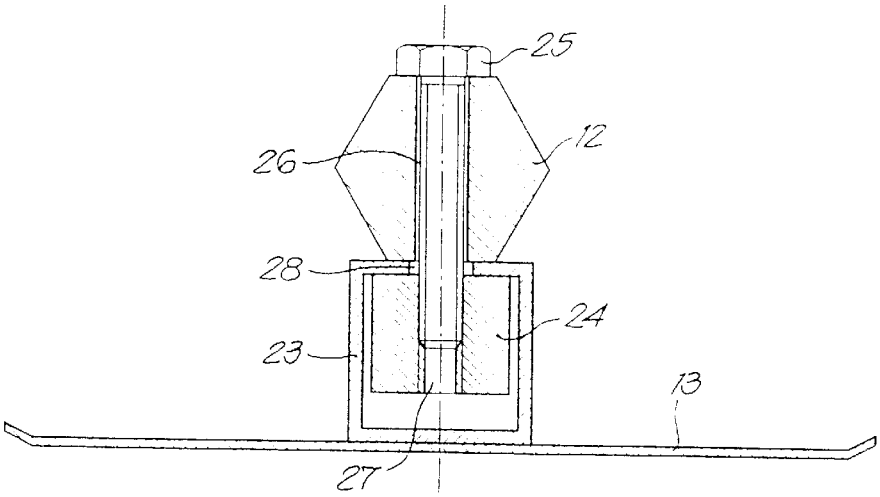
FIG. 3, at a larger scale, represents a cross-section according to line III—III in FIG. 2, but with the parts in mounted condition.

As represented in FIG. 2, each arm 12 is attached to the hub 11 adjustable around its longitudinal direction, as it fits with a round extremity in a tubular portion 11A of the hub 11.

This arm 12 is retained in this portion 11A by means of a bolt 15 which protrudes through this portion into a groove 15A in the arm 12.

A ring 16, which, by means of a bolt 17 and a locking nut 18 screwed thereupon, can be locked against a hexagonal portion of the arm 12, is provided with an arm 19 situated next to the tubular portion 11A.

By means of this arm 19, the arm 12 can be adjusted around its longitudinal axis and, therefore, the angle of the blade 13 attached thereto can be adjusted by means of a mechanism, not represented in the figures and provided between the hub 11 and the reduction box on the shaft of this latter.

A bolt 21 which is screwed through this arm 19 and can be locked by means of a locking nut 20 allows for a fine adjustment of the aforementioned angle.

Between the ring 16 and the tubular portion 11A, an O-ring 22 is provided around arm 12 in order to prevent dirt from penetrating into the portion 11A.

The portion of the arm 12 which is turned away from the hub 11 is hexagonal.

The connection 14 substantially consists of a channel or open-box profile 23 which is attached to the upper side of the blade 13, for example, welded thereto, and a beam 24 fitting with a play into the open-box profile 23 and being connected to the arm 12 by means of fixation means, to wit two screws or bolts 25.

These bolts 25 loosely extend through openings 26 through the hexagonal extremity of the arm 12 and are screwed into openings 27, provided with screw thread, in the beam 24.

The open-box profile 23 in fact is a profile, open at the extremities, with a C-shaped cross-section or, in other words, a rectangular or square tubular profile, in the upper side of which, over the entire length, there is a slot 28 in the center through which the bolts 25 may pass loosely.

Next to the outermost-situated extremity of the beam 24, this beam is passed by one or more, in the represented example, three, openings 29, 30 and 31 directed perpendicular to the arm 12 and parallel to the blade 13.

A lockable pin 32, which is wider than the beam 24, can be put through one of the openings 29, 30 or 31 in order to allow a fast adjustment of preferred positions of the blade 13, as will be explained in the following.

Connecting a blade 13 and an arm 12 takes place as follows:

If necessary, the bolts 25, with which the beam 24 is fixed to the arm 12, are unscrewed, without completely releasing the beam 24.

The open-box profile 23, which is fixed onto the blade 13, is slid over the beam 24, whereby the hexagonal portion of the arm 12 remains outside the open-box profile 23 and the two bolts 25 with a portion thereof extend through the slot 28.

The blade 13 is placed in radial direction into the desired position, after which the bolts 25 are screwed in as far as possible.

As a result thereof, the portions of the open-box profile 23 which are situated at opposite sides of the slot 28 are clamped between the beam 24 and the arm 12, as a result of which the blade 13 is fixed to the arm 12.

The beam 24 which is clamped against the open-box profile 23 reduces or prevents the bending of this open-box profile 23.

In this manner, the position of the blade 13 is continuously adjustable in radial direction, within limits.

So, the blades 13 of one or both tools 2 can be adjusted such that they can finish a surface close to the upright walls. As a result of this, the necessary manual finishing along the walls is reduced.

Then, a usual finishing device can be used as an edge-finishing device, such that no separate device is necessary for finishing the borders.

The fixation of the blade 13 on the arm 12 can be performed rapidly, in consideration of the fact that the bolts 25 only have to be screwed in by several turns in order to fixedly clamp the open-box profile 23.

The loosening of the blade 13 from the arm 12 can also be performed in a rapid manner. It suffices to unscrew the bolts 25 a little and to shift the open-box profile 23 off the beam 24.

In this manner, a blade 13, for example, for the normal polishing finish of a surface, can be replaced by another blade 13A, for example, for a pre-processing, or a blade 13B.

Where a blade 13 is worn out, it is thrown away together with the open-box profile 23. The mostly longer and heavier and therefore also more expensive beam 24 remains with the arm 12 and, therefore, with the device.

The beam 24 includes a mark 40 located along the outermost extremity thereof to determine a standard position of the blade.

Polishing blades, such as he represented blade 13, mostly can be used double-sided, such that, when the side situated foremost in turning direction is worn, the blade 13 can be turned over 180° and can be fixed to the arm 12 again, with the other edge to the front.

Although a blade 13 is continuously adjustable in respect to the arm 12, the openings 29, 30 and 31 determine three standard positions thereof.

To this end, the open-box profile 23 is slid over the beam 24 in such a manner that the extremity of the beam 24 protrudes, such that the opening 29, 30 or 31 corresponding to the desired standard position is situated out of the open-box profile 23, after which the pin 32 is put through said opening and the open-box profile 23 is moved back up to against the extremities of the pin 32 which protrude from the beam 24 and therefore form a stop, and finally the bolts 25 are tightened.

Figure 4:
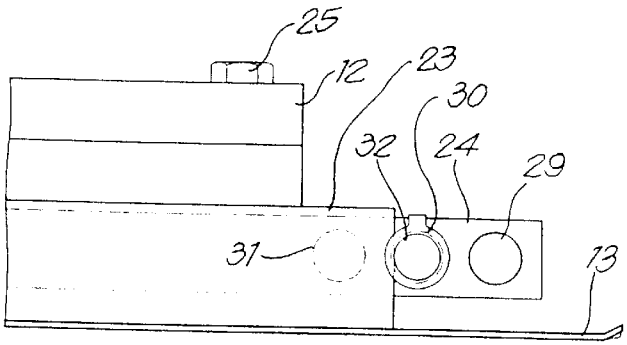
FIG. 4 represents a side view of an extremity of an arm with blade of the finishing device of the preceding figures.

In FIG. 4, a portion of an arm 12 is represented to which a blade 13 in such standard position is attached. The pin 32 is provided, for example, through the central opening 30.

It is obvious that a stop, such as a pin 32, is no really necessary for he determination of standard positions.

Instead of one or more openings 29, 30 and 31 and a pin 32, one or more marks can be provided on the beam 24, such that the user can see how far one has to shift the open-box profile 23 over the beam 24.

Instead of being welded to the blade 13, the open-box profile 23 can be attached thereto by means of rivets or similar. Of course, the play in the vertical direction of the beam 24 in the open-box profile 23 must be sufficiently large in order to allow the presence of the heads of these rivets or similar on the bottom of the open-box profile 23.

The connecting means connecting the beam 24 to an arm 12 do not necessarily have to be screws or bolts screwed into this beam 24.

In a variant, these connecting means can be bolts which do not only fit loosely through the arm 12, but also fit loosely through the beam 24 and onto which nuts are screwed. Due to the open-box profile 23, the turning of the nut can be prevented, and preferably it is also prevented that the nut can be screwed completely off the bolt.

The clamping of the beam 24 in respect to the open-box profile 23 by means of these connecting means then takes place by means of screwing-in or turning the bolt in respect to the nut.

The second part of the connection 14 does not necessarily have to be a beam 24. The beam 24 can be replaced by one portion of the connecting means themselves.

Figure 5:
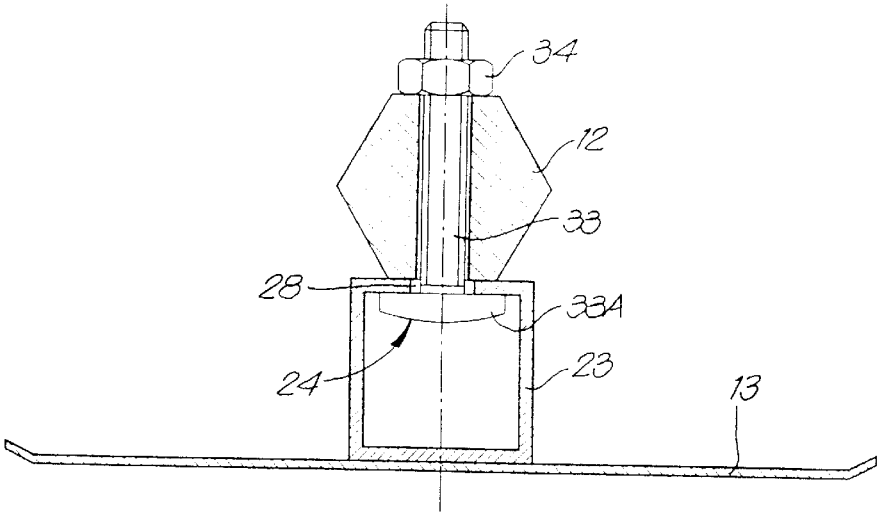
FIG. 5 represents a cross-section analogous to that of FIG. 3, however, relating to another form of embodiment of the invention.

These connecting means can be formed by bolts 33 onto which nuts 34 are screwed, as represented in FIG. 5.

The bolts 33 extend loosely through the arm 12 and through the slot 28 and are situated with their head 33A, which forms the movable and clampable second part 24 of the connection 14, in the open-box profile 23.

This head 33A is sufficiently large and preferably of such a shape that a rotation thereof in the open-box profile 23 is restricted or Impossible.

It is obvious that by the tightening of the nut 34 which is situated on top of the arm 12, the open-box profile 23 and the arm 12 are drawn towards each other and that, thus, the portions of the open-box profile 23 situated between the head 33A and the arm 12 are fixedly clamped.

By tightening the nuts 34 on both bolts 33, thus the bolts 33 and the arm 12 are fixedly clamped on the open-box profile 23.

By unscrewing the bolts 33, the open-box profile 23 can be adjusted in its longitudinal direction in respect to the arm 12.

In particular, this form of embodiment can be applied with finishing devices with long arms 12.

In the last-mentioned form of embodiment, the bolts 33 can be reversed such that their head 33A is situated at the upper side of the arm 12 and the nuts 34 are situated in the open-box profile 23 and have such a shape that they are prevented from turning, but keep their clamping function during the tightening of the bolts 33.

The number of arms 12 does not necessarily have to be four. For example, there may be three, five or six arms 12 per tool 2.

The invention is in no way limited to the form of embodiment described heretofore and represented in the figures, however, such finishing device can be realized in different variants without leaving the scope of the invention.

What is claimed is:

1. A finishing device for floors made of hardenable material, comprising:

a frame;

at least one rotating tool connected to said frame, said rotating tool including at least one arm having a blade connected thereto via a connection arrangement;

said connection arrangement including first and second parts, said first part being mounted onto said blade, said first part connecting to said second part so as to slidably engage along said second part such that said blade can be adjusted, said first part being fixedly clamped along a longitudinal dimension of said arm; and a driving mechanism provided on said frame and configured to drive said at least one rotating tool.

2. The finishing device of claim 1, wherein said first part includes a cross-sectional channel profile extending parallel to said arm, and configured and dimensioned to receive at least a portion of said second part.

3. The finishing device of claim 2, wherein the second part is a beam insertable into the cross-sectional profile of the first part, said second part and said arm defining a play therebetween to permit slidable engagement of said first part therewith, said first part being secured to said second part and said arm by a connecting device.

4. The finishing device of claim 3, wherein said beam defines along an outermost-situated extremity at least one opening directed perpendicular to a longitudinal dimension of said arm and parallel to the blade, said opening arranged to accommodate a pin that extends therethrough to prevent movement of the beam.

5. The finishing device of claim 3, wherein said beam includes along an outermost-situated extremity at least one mark for determining a predetermined position of one of said blades.

6. The finishing device of claim 1, wherein said second part is configured and dimensioned to clamp onto said first part.

7. The finishing device of claim 6, wherein at least one screw or bolt extends through the arm and connects said second part to said arm.

8. The finishing device of claim 6, wherein at least one screw or bolt extends through the arm and into the second part.

9. The finishing device of claim 1, wherein said second part extends through said arm and clamps onto said first part.

10. The finishing device of claim 1, wherein the second part includes at least one bolt with a nut, said bolt extending through the arm and a slot defined along the cross-sectional profile of said first part, wherein said bolt is secured to said first part by said nut and defines the second part.

* * * * *